US006605790B2

(12) United States Patent
Yoshida

(10) Patent No.: US 6,605,790 B2
(45) Date of Patent: Aug. 12, 2003

(54) SWITCH APPARATUS

(75) Inventor: Motoharu Yoshida, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 10/277,743

(22) Filed: Oct. 23, 2002

(65) Prior Publication Data

US 2003/0085110 A1 May 8, 2003

(30) Foreign Application Priority Data

Nov. 7, 2001 (JP) ..... 2001-341895

(51) Int. Cl.[7] ..... H01H 23/02
(52) U.S. Cl. ..... 200/339; 200/553
(58) Field of Search ..... 200/4, 5 R, 6 R, 200/6 A, 17 R, 18, 339, 553

(56) References Cited

U.S. PATENT DOCUMENTS 5,584,380 A * 12/1996 Naitou ..... 200/315
5,689,095 A * 11/1997 Kawase ..... 200/5 R
5,691,517 A * 11/1997 Yamamoto et al. ..... 200/6 A
5,957,273 A * 9/1999 Karasik ..... 200/556
6,140,713 A 10/2000 Stringwell ..... 307/10.1

* cited by examiner

*Primary Examiner*—Michael Friedhofer
(74) *Attorney, Agent, or Firm*—Morgan, Lewis & Bockius LLP

(57) ABSTRACT

A switch apparatus includes pushers (20, 21) for operating the switch bodies (17, 18), provided between an operating element (22), which is adapted to undergo a turning operation, and each of switch bodies. The pushers are configured in such a way as to be guided by pusher guides (15, 16) at places, each of which is located away from between a corresponding one of the switch bodies and a corresponding one of parts (24, 25) of the operating element for forcedly pushing the pushers. This eliminates the necessity for ensuring the necessary length (L11) of each of the pusher guides (15, 16), each of which is used for performing operations of forcedly pushing the switch bodies, between a corresponding one of the switch bodies and a corresponding one of the parts of the operating element for pushing the pushers.

5 Claims, 4 Drawing Sheets

SWITCH APPARATUS

BACKGROUND OF THE INVENTION

The present invention relates to a switch apparatus having a pusher provided between an operating element and a switch body.

Hitherto, a conventional apparatus illustrated in FIG. 4 has been provided as a switch apparatus having a pusher provided between an operating element and a switch body. In this conventional apparatus, an operating element 2 includes an intermediate portion 2*a* in a lateral direction, as viewed in this figure, which is pivotally supported by a case 1*a* through a shaft 3 in such a manner as to be able to upwardly and downwardly turn. A projection 4 is provided at a portion, which is placed at right side away from the pivotally supported portion (that is, the intermediate portion 2*a*) of this operating element 2, as viewed in this figure, in such a way as to downwardly project therefrom.

A linear-rod-like pusher 5 is disposed under the projection 4. A pusher guide 7 having a guide hole 6 for guiding this pusher 5 in such a way as to be able to upwardly and downwardly move in a linear direction is formed integrally with the case 1 and thus provided and fixed therein.

A switch body 8 having an actuator 8*a* is provided under the pusher 5 by being mounted on a circuit board 9. This circuit board 9 is fixed to the case 1.

In the conventional apparatus of this configuration, when the right-side portion of the operating element 2 is downwardly pushed down into a space, the projection 4 downwardly pushes the pusher 5. Then, the pusher 5 downwardly pushes the actuator 8*a* of the switch body 8. Thus, an operation of forcedly pushing the switch body 8 is performed, so that the switch body 8 is put into a conducting state.

When the forced pushing of the operating element 2 is canceled from the pushing state, the pusher 5 is upwardly pushed back by a restoring force of the switch body 8 which returns the actuator 8*a*, and the right-side portion of the operating element 2 is upwardly pushed back through the projection 4. As the pusher 5 is pushed back, the switch body 8 returns to an interrupting state.

In the aforementioned conventional apparatus, the pusher guide 7 is operative to guide the pusher 5 so that the pusher 5 vertical moves in the linear direction in response to an upward or downward turn (that is, a circular arc motion around the shaft 3) of a portion in which the projection 4 of the operating element 2 is present. Thus, the pusher guide 7 serves to enable the apparatus to properly perform an operation of forcedly pushing the switch body 8, that is, to obtain a reliable conductive state by downwardly and forcedly pushing the switch body 8 in a straight direction. Therefore, the length L1 of the pusher guide 7 should be somewhat large.

Thus, in the case of the aforementioned conventional apparatus, the pusher guide 7 having the length L1 is disposed between the switch body 8 and the projection 4 for forcedly pressing the pusher 5 of the operating element 2. Therefore, the switch body 8, the pusher guide 7, and the operating element 2 are sequentially stacked. Consequently, the conventional apparatus has drawbacks in that the thickness t1 of the entire switch apparatus is large, and that thus, the required installation space of the switch apparatus is large.

SUMMARY OF THE INVENTION

The invention is accomplished in view of the aforementioned circumstances. Accordingly, an object of the invention is to provide a switch apparatus enabled to properly perform an operation of forcedly pushing a switch body and to reduce the thickness of the entirety thereof.

To achieve the foregoing object, according to the invention, there is provided a switch apparatus, which comprises an operating element pivotally supported in such a way as to be able to forcedly push and turn in a direction opposite to a direction in which the operating element pushes, a pusher to be pushed by a part of the operating element, which part is disposed at a place located away from a pivotally supported portion thereof, a pusher guide for forcedly pushing and guiding the pusher in such a manner as to be able to move the pusher in a linear direction opposite to a direction in which the pusher is forcedly pushed, and a switch body that undergoes a forced pushing operation to be performed by the pusher. In this apparatus, a guided portion located away from between the switch body and the part of the operating element, which part forcedly pushes the pusher, is formed in the pusher. Further, the pusher guide is provided at a place located away from between the switch body and the part of the operating element, which part forcedly pushes the pusher. Furthermore, the pusher guide guides the guided portion in such a way as to be able to move the pusher in the linear direction.

In order to solve the aforesaid object, the invention is characterized by having the following arrangement.

(1) A switch apparatus comprising:

an operating element pivotally supported through a pivotally supported portion thereof;

a pusher to be pushed by a pushing part of the operating element, the pushing part being disposed at a place shifted from the pivotally supported portion;

a switch body to be pushed by the pusher;

a guided portion away from a portion between the switch body and the pushing part, formed in the pusher; and a pusher guide for guiding the guided portion in a linear direction, which is arranged at a place away from the portion between the switch body and the pushing part.

(2) The switch apparatus according to (1), wherein the pusher includes the guided portion guided by the pusher guide and a main body portion which is pushed by the operating element and pushes the switch body.

(3) The switch apparatus according to (2), wherein the main body portion is shorter than the guided portion in the linear direction.

(4) The switch apparatus according to (3), wherein the main body portion is shorter than the pusher guide in the linear direction.

(5) The switch apparatus according to (2), wherein the pusher includes an arm which is extended in a direction substantially perpendicular to the linear direction and connects the main body portion to the guided portion.

DETAILED DESCRIPTION OF PREFERRED EMBODIMENTS

Hereinafter, an embodiment, which is an example of the application of the invention to a volume control switch device for use in an audio apparatus of a vehicle, especially, an automobile, will be described with reference to FIGS. 1 to 3.

Figure 3:
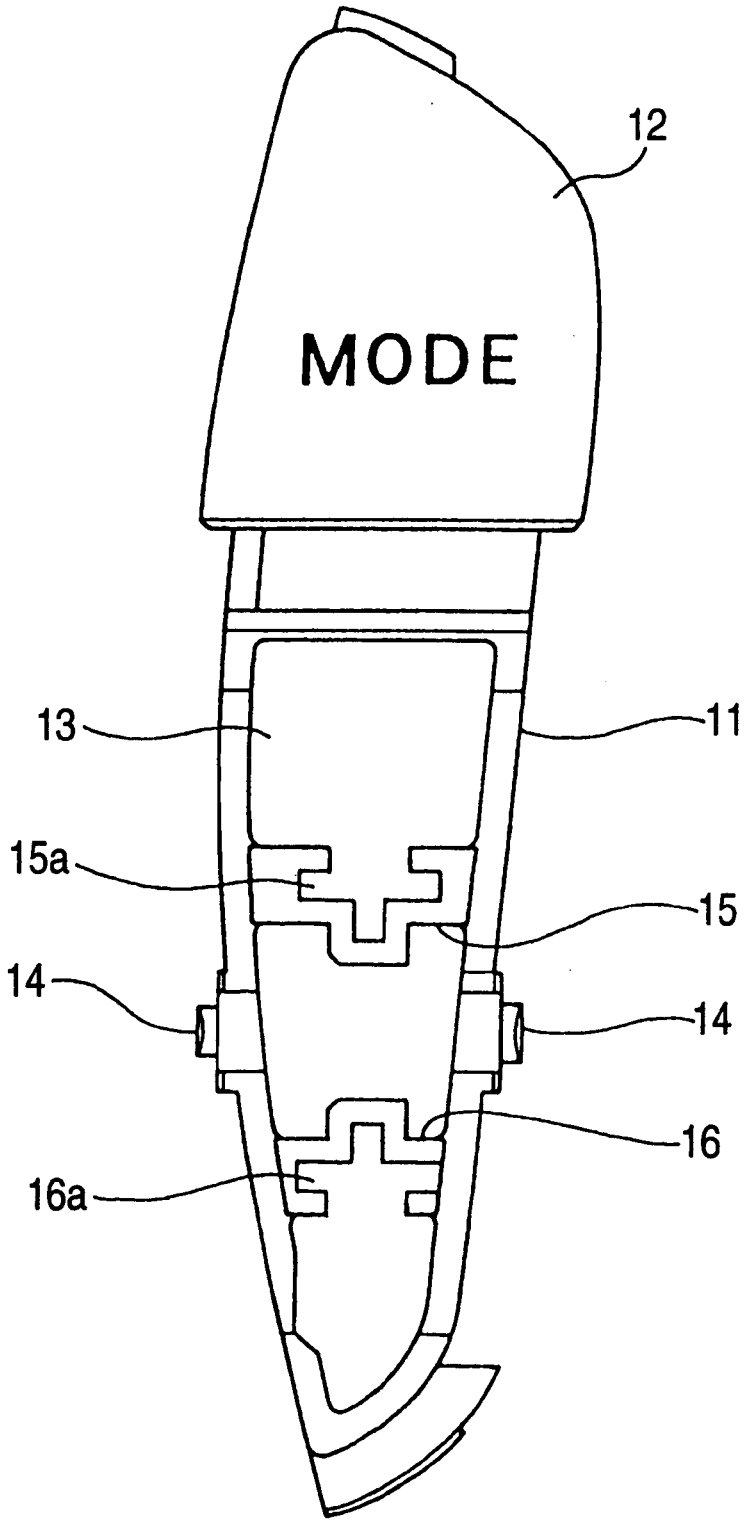
FIG. 3 is a plan view illustrating a primary part of a case.
Figure 4:
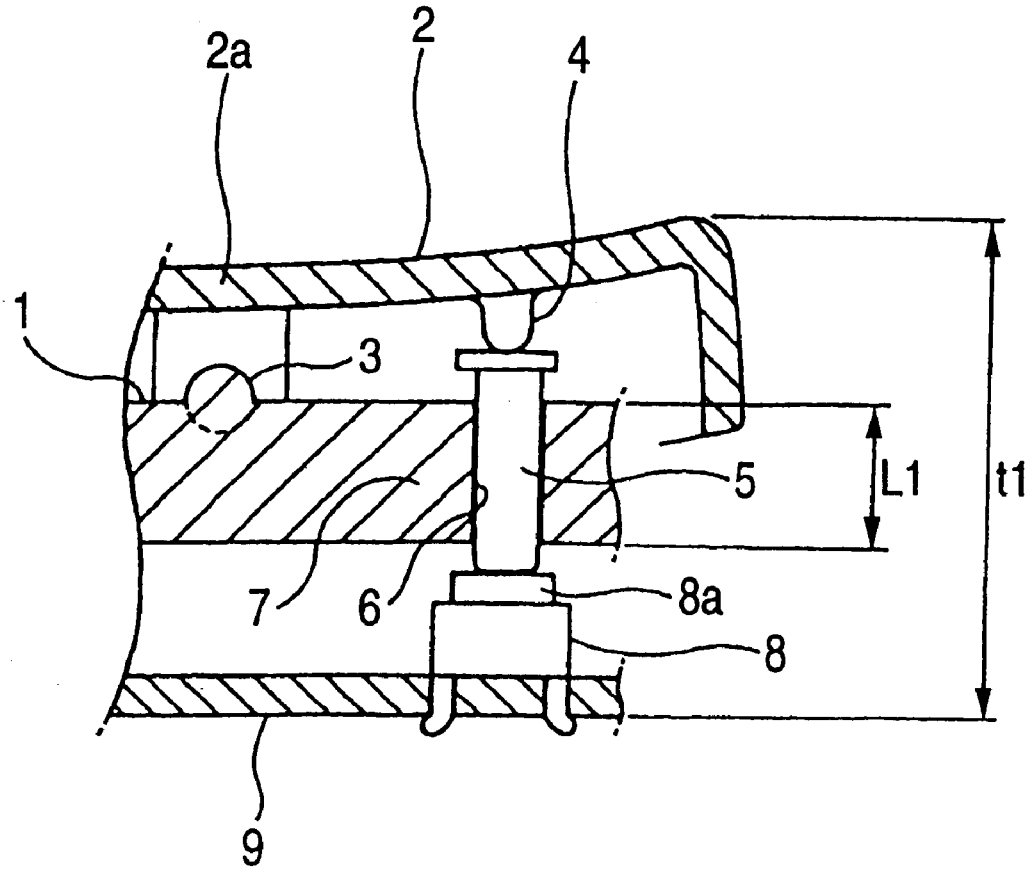
FIG. 4 PRIOR ART
FIG. 4 is a view illustrating a conventional switch apparatus, which partly corresponds to FIG. 1.

Referring to FIG. 3, there is shown a case 11 that is in a state in which only one of operating elements 12 at one side is mounted on the case 11. This case 11 is almost in a boat form. The case 11 includes an accommodating portion 13 provided at the side (that is, a lower side, as viewed in FIG. 3) opposite to the side of the operating element 12.

In an accommodating portion 13, projections 14 of short length having cylinder shape are formed on the front-side edge portions of both the left-side and right-side walls of a central portion in such a way as to be integral therewith and as to slightly outwardly project therefrom, as viewed in this figure. Pusher guides 15 and 16 are respectively disposed at an upper side part and a lower side part of the accommodating portion 13, as viewed in this figure, and similarly formed in such a way as to be integral therewith. These pusher guides 15 and 16 form T-shaped grooves 15*a* and 16*a*, respectively, and are respectively placed at upper and lower positions in such a manner as to be symmetrical with respect to the center of the portion 13. The groove 15*a* of the upper pusher guide 15 is upwardly opened, while the groove 16*a* of the lower pusher guide 16 is downwardly opened.

Figure 1:
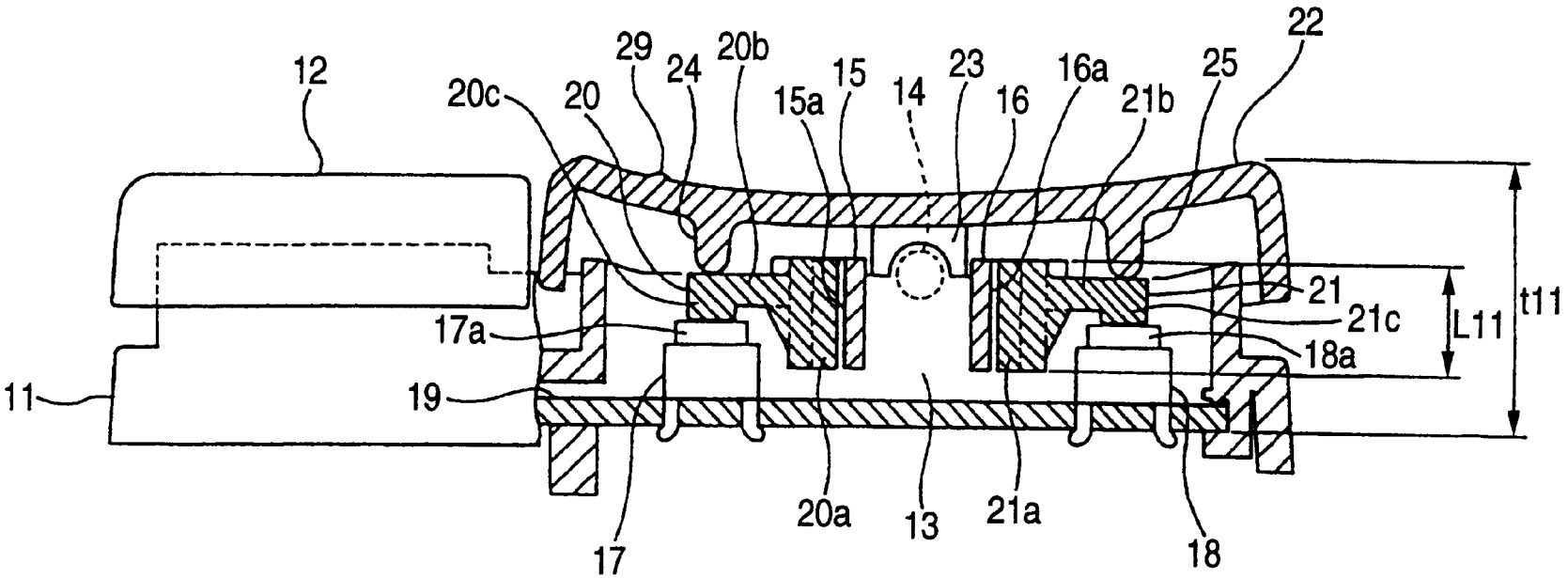
FIG. 1 is a broken side view illustrating an embodiment of the invention.

On the other hand, as illustrated in FIG. 1, a circuit board 19, on which switch bodies 17 and 18 are mounted, is accommodated and fixed in the accommodating portion 13. In this case, the switch bodies 17 and 18 are constituted by tact switches, and respectively have actuators 17*a* and 18*a*, each of which protrudes upwardly. Further, these switch bodies 17, 18 are placed closer to the side opposite to the projection 14 (that is, to the side of a counter-projection 14) than the pusher guides 15 and 16.

Pushers 20 and 21 are placed on the switch bodies 17 and 18, respectively. As illustrated in FIG. 2, each of these pushers 20 and 21 is formed so that a corresponding one of guided portions 20*a* and 21*a* is integral with corresponding ones of arms 20*b* and 21*b* and main body portions 20*c* and 21*c*. Each of the guided portions 20*a* and 21*a* has a planar T-shaped configuration, similarly as the grooves 15*a* and 16*a* of the pusher guides 15 and 16, and upwardly and downwardly extends in such a way as to have a length L11. The arms 20*b* and 21*b* are extended from the guided portions 20*a* and 21*a*, respectively. Each of the main body portions 20*c* and 21*c* is formed under an end portion of a corresponding one of the arms 20*b* and 21*b*. In this case, each of the main body portions 20*c* and 21*c* is shaped like a short-length circular cylinder, and has a length L12 that is shorter than the length L11 of the guided portions 20*a* and 21*a*.

As shown in FIG. 1, each of the guided portions 20*a* and 21*a* is inserted into a corresponding one of the grooves 15*a* and 16*a* of the pusher guides 15 and 16 from above. Thus, the pushers 20 and 21 are enabled to upwardly and downwardly move in a linear direction by guiding the guided portions 20*a* and 21*a*. Incidentally, the pusher guide 15 and 16 have a length that is nearly equal to the length L11 of the guided portions 20*a* and 21*a*. In this case, the arms 20*b* and 21*b* are respectively projected from left-side and right-side opened apertures. The main body portions 20*c* and 21*c* are put on the actuators 17*a* and 18*a* of the switch bodies 17 and 18, respectively.

On the other hand, the operating element 22 is shaped like a cap that is much larger than the accommodating portion 13. A shaft journal part of the operating element 22 is formed at a lower part of the central portion of the operating element 22 in such a way as to be integral therewith. The top face of the operating element 22 has a warp that is curved from the central part thereof upward to lateral sides thereof, as viewed in FIG. 1. Moreover, the operating element 22 includes projections 24 and 25 formed at places, which are located laterally away from the central part thereof, on the bottom face of the operating element 22 in such a manner as to protrude therefrom, as viewed in FIG. 1.

The journal part of the operating element 22 is fitted onto each of the projections 14 of the case 11. Consequently, the operating element 22 is attached and supported thereon in such a way as to be able to upwardly and downwardly turn around each of the projections 14. In this case, the direction of the upward or downward turn of the operating element 22 is a forced pushing direction in which the operating element 22 is forcedly pushed, or a direction opposite to the forced pushing direction. This attachment of the operating element 22 results in that the bottom ends of the projections 24 and 25 are put on the main body portions 20*c* and 21*c* of the pushers 20 and 21. Furthermore, the operating element 22 is adapted so that the entirety thereof covers the whole accommodating portion 13.

Figure 2:
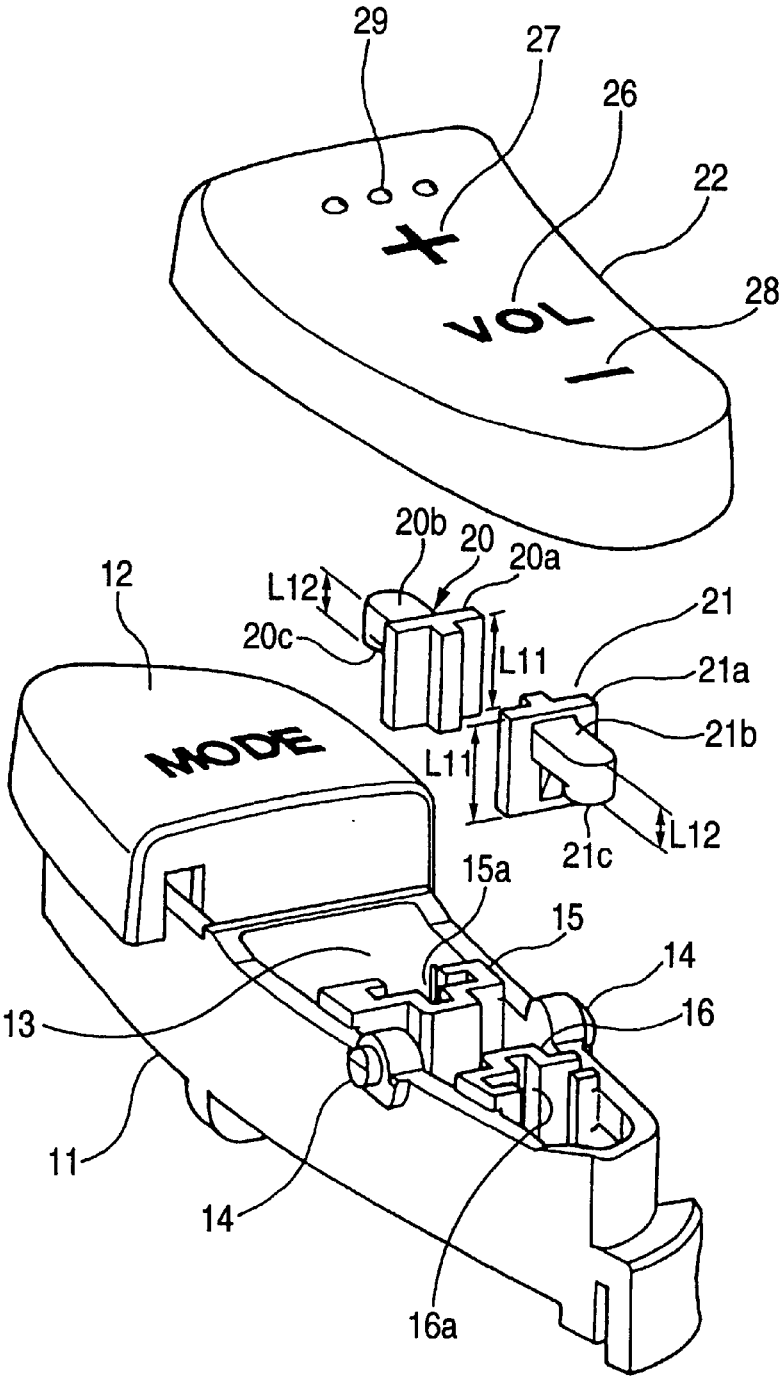
FIG. 2 is an exploded perspective view illustrating the embodiment.

Incidentally, as shown in FIG. 2, necessary indications 26, 27, and 28 and a projection for a blind operation are provided on the top face of the operating element 22.

With the aforementioned configuration, when the left-side part of the operating element 22 is downwardly pushed into a space, as viewed in FIG. 1, the operating element 22 turns anticlockwise, so that the main body portion 20*c* of the pusher is pushed down by the projection 24 that performs a circular arc motion. When the right-side part of the operating element 22 is downwardly pushed into a space, as viewed in FIG. 1, the operating element 22 turns clockwise, so that the main body portion 21*c* of the pusher 21 is pushed down by the projection that performs a circular arc motion.

At that time, the projections 24 and 25 are placed at parts located laterally away from the central portion of the operating element 22 pivotally supported by the projection 14 of the case 11, that is, the pivotally supported part of the operating element 22. Therefore, the pushers 20 and 21 are forcedly pushed by the parts located away from the pivotally supported portion of the operating element 22. The pushed pushers 20 and 21 are respectively guided by the pusher guides 15 and 16, which act upon the guided portions 20*a* and 20*b*, in such a way as to downwardly move in a linear direction.

Then, the movement of the pusher 20 results in that the actuator 17*a* of the switch body 17 is downwardly pushed. Thus, the switch body 17 undergoes a forced pushing operation, so that the switch apparatus is put into a conducting state. In this case, the magnitude of sounds radiated from the audio apparatus of the automobile is increased. Furthermore, the movement of the pusher 21 results in that the actuator 18*a* of the switch body 18 is downwardly and forcedly pushed. Thus, the switch body 18 undergoes a forcedly pushing operation, so that similarly, the switch apparatus is put into a conducting state. In this case, the magnitude of sounds radiated from the audio apparatus of the automobile is decreased. The aforementioned length L11 of the pusher guides 15 and 16 is a length required to cause the pushers 20 and 21 to properly perform operations of forcedly pushing the switch bodies 17 and 18.

At that time, each of the pusher guides 15 and 16 is disposed away from a portion between a corresponding one of the switch bodies 17, 18 and a corresponding one of the parts (the projections 24 and 25) which push the pushers 20 and 21 of the operating element 22, toward the projection 14 of the case 11, which is a support shaft for the operating element 22. Each of the guided portions 20*a* and 21*a* of the pushers 20*a* and 21*a* of the pushers 20 and 21 is disposed away from a portion between a corresponding one of the switch bodies 17, 18 and a corresponding one of the parts (the projections 24 and 25) which forcedly push the pushers 20 and 21 of the operating element 22, toward the projection 14 of the case 11.

Incidentally, when the forced pushing of the operating element 22 is canceled during each of the aforementioned states, the pushers 20 and 21 are upwardly pushed back by restoring forces of the switch bodies 17 and 18. Moreover, the operating element 22 is upwardly pushed back through the projections 24 and 25, which respectively return the actuators 17*a* and 18*a*. Furthermore, as the pushers 20 and 21 are pushed back, the switch bodies 17 and 18 return to an interrupting state.

Thus, according to the apparatus of this configuration, each of the pushers 20 and 21 is guided by a corresponding one of the pusher guides 15 and 16 at a place away from between a corresponding one of the switch bodies 17 and 18 and a corresponding one of the parts which push the pushers 20 and 21 of the operating element 22. Therefore, the necessary length L11 of each of the pusher guides 15 and 16 for properly performing operations of forcedly pushing a corresponding one of the switch bodies 17 and 18 is assured at a place away from a portion between a corresponding one of the switch bodies 17 and 18 and a corresponding one of the parts of the operating element 22, which are used for forcedly pushing the pushers 20 and 21. Thus, differently from the conventional apparatus, according to this embodiment, there is no need for ensuring the necessary length L11 of each of the pusher guides 15 and 16 for properly performing operations of forcedly pushing the switch bodies 17 and 18 at a place away from a portion between a corresponding one of the switch bodies 17 and 18 and corresponding one of the parts of the operating element 22 (incidentally, the length L12 of each of the main body portions 20*c* and 21*c* of the pushers 20 and 21, which should be assured, is shorter than the necessary length L11 of each of the pusher guides 15 and 16).

Thus, in the case of the apparatus of this configuration, operations of forcedly pushing the switch bodies 17 and 18 are properly performed. Simultaneously, the thickness t11 of the entire switch apparatus can be reduced. Consequently, the installation space of the switch apparatus can be made to be small.

Incidentally, the scope of application of the invention is not limited to a volume control switch device for use in an audio apparatus of a vehicle, especially, an automobile. The invention may be widely applied to general switch devices. Further, instead of placing each of the guided portions 20*a* and 21*a* of the pushers 20 and 21 and the pusher guides 15 and 16 at a place away from a portion between a corresponding one of the switch bodies 17 and 18 and the parts for forcedly pushing the pushers 20 and 21 of the operating element 22 to the projection 14 of the case 11, each of the guided portions 20*a* and 21*a* of the pushers 20 and 21 and the pusher guides 15 and 16 may be placed at a position located away from therebetween to a side opposite to the projection 14.

Additionally, the pusher guides 15 and 16 may be formed in such a manner as to be separated from the case 11 and fixed by being incorporated into the case 11, instead of being formed in such a way as to be integral with the case 11. Moreover, the switch bodies 17 and 18 are not limited to tact switches. Furthermore, any other switches may be employed as long as an operation of forcedly pushing thereof is performed by the pushers 20 and 21.

Further, the invention is not limited to the embodiments described above and illustrated in the accompanying drawings. Especially, the invention can be practiced by suitably changing the practical shapes of constituent elements of the invention without departing from the gist thereof.

As described above, according to the switch apparatus of the invention, an operation of forcedly pushing the switch body can be properly performed. Moreover, the thickness of the entire switch apparatus can be reduced.

What is claimed is:

1. A switch apparatus comprising:

an operating element pivotally supported through a pivotally supported portion thereof;

a pusher to be pushed by a pushing part of the operating element, the pushing part being disposed at a place shifted from the pivotally supported portion;

a switch body to be pushed by the pusher;

a guided portion away from a portion between the switch body and the pushing part, formed in the pusher; and a pusher guide for guiding the guided portion in a linear direction, which is arranged at a place away from the portion between the switch body and the pushing part.

2. The switch apparatus according to claim 1, wherein the pusher includes the guided portion guided by the pusher guide and a main body portion which is pushed by the operating element and pushes the switch body.

3. The switch apparatus according to claim 2, wherein the main body portion is shorter than the guided portion in the linear direction.

4. The switch apparatus according to claim 3, wherein the main body portion is shorter than the pusher guide in the linear direction.

5. The switch apparatus according to claim 2, wherein the pusher includes an arm which is extended in a direction substantially perpendicular to the linear direction and connects the main body portion to the guided portion.

* * * * *